United States Patent [19]

Hansen et al.

[11] 4,334,843

[45] Jun. 15, 1982

[54] GEROTOR MACHINE WITH VALVE PLATES ATTACHED TO WHEEL GEAR

[75] Inventors: Christian B. Hansen, Nordborg, Denmark; Carl D. Flagstad, Sonderborg, Denmark

[73] Assignee: Danfoss A/S, Nordborg, Denmark

[21] Appl. No.: 146,346

[22] Filed: May 5, 1980

[30] Foreign Application Priority Data

May 17, 1979 [DE] Fed. Rep. of Germany ..... 2919871

[51] Int. Cl.[3] ..... F01C 1/10; F01C 21/12; F03C 2/08; F04C 2/10

[52] U.S. Cl. ..... 418/61 B; 418/186

[58] Field of Search ..... 418/61 B, 186

[56] References Cited

U.S. PATENT DOCUMENTS 2,871,831 2/1959 Patin ..... 418/61 B
3,221,664 12/1965 Jernaes ..... 418/61 B
3,598,509 8/1971 Goff et al. ..... 418/61 B
4,087,215 5/1978 Miller ..... 418/61 B

*Primary Examiner*—John J. Vrablik
*Attorney, Agent, or Firm*—Wayne B. Easton

[57] ABSTRACT

The invention relates to a fluid pressure operated motor or pump of the type having a gerotor displacement mechanism which normally includes inner and outer wheel and ring gears which in operation have relative rotational and orbital movement therebetween. Such devices inherently have a form of valving wherein, with a commutating type of action, fluid is directed from the casing inlet to expanding chambers of the gerotor and directed from collapsing gerotor chambers to the casing outlet. In the unit herein the commutator valving includes two valve plates attached to opposite sides of the orbiting and rotating wheel gear which have the commutating action with the surrounding stationary ring gear.

1 Claim, 3 Drawing Figures

GEROTOR MACHINE WITH VALVE PLATES ATTACHED TO WHEEL GEAR

The invention relates to a hydraulic rotary piston machine comprising a gear with external teeth, and, eccentric thereto, a gear ring with internal teeth, which rotate and orbit relatively to each other, a first distributor plate which is disposed in a chamber connected to the one connection, abuts the gear and gear ring, is fixed to the gear and, at the periphery, has a number of first control recesses corresponding to the number of teeth on the gear, said recesses temporarily freeing the gaps between adjacent teeth of the gear ring, and an equal number of second control recesses disposed between the first control recesses and connected to the other connection.

In a previous proposal (German pat. application No. P 27 52 036), the two control apertures in the distributor plate are in the form of holes respectively disposed between the first control recesses. They communicate by way of radial grooves with a central bore of the housing which, in turn, leads to the other connection.

Such a hydraulic rotary piston machine is suitable for operation only at a limited speed. At higher speeds, there are impermissibly large leakage losses. In addition, production problems arise in the manufacture of the distributor plate.

The invention is based on the problem of providing a hydraulic rotary piston machine of the aforementioned kind which, when of the same size, can be operated at higher speeds and made more easily.

This problem is solved in accordance with the invention in that the second control apertures are provided as recesses at the periphery of a second distributor plate which is disposed in a chamber connected to the other connection, abuts the other side of the gear and gear ring and is fixed to the gear, the second control apertures having substantially the same shape as the first control recesses but being arranged in mirror image with respect to a diametric line.

With this construction, both distributor plates can be stamped out of sheet metal or produced as sintered bodies of the same thickness. The recesses of both distributor plates are connected to the respective connections with practically no resistance; they can also be made adequately large. Consequently one does not have the throttling losses which are unavoidable in a radial groove. The machine can therefore also be driven at higher speeds, i.e. with a higher throughput. Further, a lower starting pressure is sufficient to set a motor of this kind into motion. Despite all this, no longer axial length of the machine is required because the two distributor plates can each be thinner than the known distributor plate having radial grooves.

In one embodiment, in which the first distributor plate is connected to the gear by pins, it is advisable for these pins also to pass through the second distributor plate and to be inserted with a slide fit. The easy relative mobility of the parts permitted by the slide fit is desirable so that the distributor plates can readily abut the gear and gear ring from both sides.

The invention will now be described in more detail with reference to a preferred example illustrated in the drawing, wherein.

Figure 2:
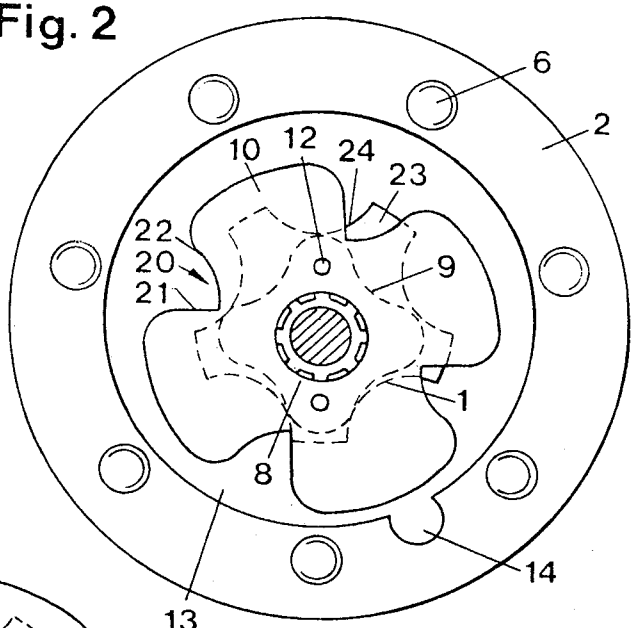
FIG. 2 is a section on the line 2—2 in FIG. 1.

The illustrated machine can be operated selectively as a pump or motor. Its housing possesses an annular plate 2 and 3 on each side of a gear ring 1 and a respective cover 4 and 5 on the outside. These parts are held together by screws 6.

A main shaft 7 which may be in the form of a cardan shaft has a serrated articulated head 8 engaged in a gear 9. On both sides of the gear there is a distributor plate 10 and 11, respectively. These three parts are interconnected by pins 12 inserted with a slide fit.

The distributor plate 10 is disposed in a chamber 13 connected to the one connection 16 by way of an axial passage 14 and a radial bore 15. The distributor plate 11 is disposed in a chamber 17 connected to the other connection 19 by way of radial passage 18.

At the periphery 4, the distributor plate 10 has recesses 20 which are each bounded by a line 21 parallel to the diameter and an arc 22. These recesses temporarily free grooves 23 between adjacent teeth 24 of the gear ring 1, as is illustrated for two adjacent grooves in FIG. 2. The distributor plate 11 comprises corresponding recesses 25 at the periphery. These are again bounded by a straight line 26 parallel to the diameter and an arc 27. They also temporarily free grooves 23 between adjacent teeth 24 of the gear ring 1. FIG. 3 shows that this is the case for two adjacent grooves 23 which are disposed in mirror image opposite the grooves freed by the distributor plate 10. During operation as a motor, pressure fluid is for example fed to the grooves freed by the distributor plate 10 whereas pressure fluid is withdrawn from the grooves freed by the distributor plate 11. Since these grooves are in each case parts of compression chambers between the gear 9 and gear ring 1, the gear will turn in the direction of the arrow P in FIG. 3. This also causes a change in the covering conditions at the grooves in a manner such that continuous rotation of the gear 9 is produced.

Figure 3:
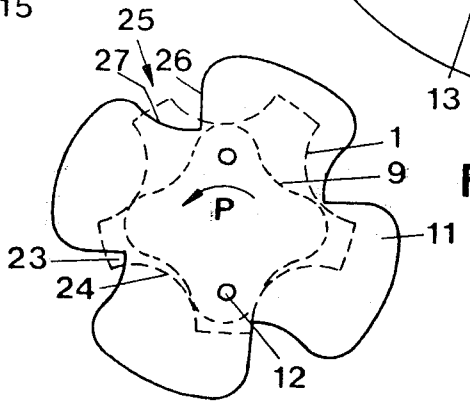
FIG. 3 is a plan view of a distributor plate on the sectional plane 3—3, the outer contour of the gear and the inner contour of the gear ring being shown in broken lines.
Figure 1:
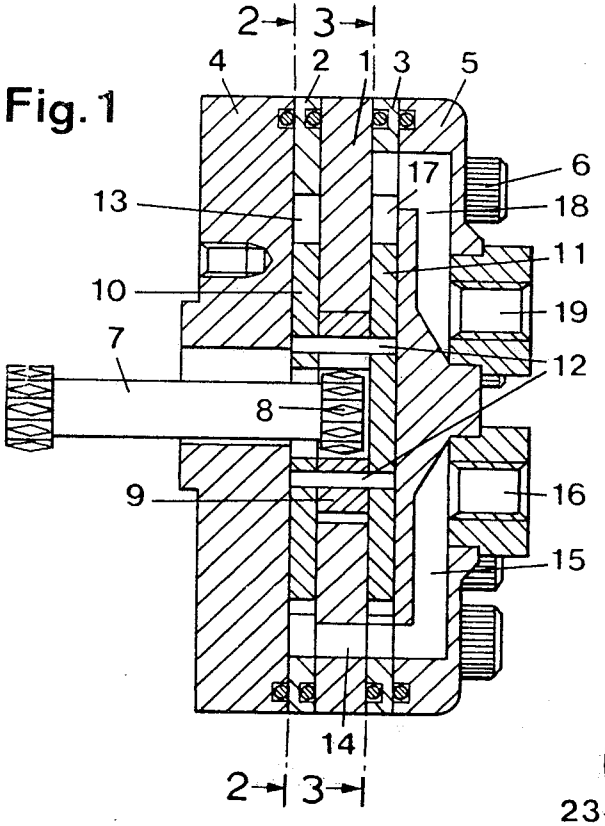
FIG. 1 is a longitudinal section through a rotary piston machine according to the invention.

If one places the distributor plate 11 of FIG. 3 on the distributor plate 10 of FIG. 2, one will see that the recesses 20 and 25 are in respective mirror-image symmetry to a diametric line passing centrally through the opposite teeth of the gear 9. The arc 22 or 27 here corresponds to the shape of a gear 24 of the gear ring and the spacing between the straight lines 21 and 26 of the recesses 20 and 25 corresponds to the width of the groove 23 at the root of the teeth.

This embodiment is also suitable for machines with more than four teeth on the gear and more than five teeth on the gear ring.

What is claimed is:

1. A rotary piston machine, comprising, a casing, radially inner and outer gerotor type wheel and ring gears having rotatable and orbital movement relative to each other and being operable to form expansible chambers therebetween with the orbital movement of said wheel gear relative to said ring gear causing the line of eccentricity therebetween to rotate relative to the axis of said ring gear, said ring gear being in fixed relation to said casing, drive means connected to said wheel gear, said wheel gear having distributor valve plates attached to opposite sides thereof, said casing forming axially spaced sidewalls engaging said valve plates in sealing engagement and forming with said casing and said ring gear first and second chambers respectively and radially surrounding said plates, inlet and outlet ports in said casing respectively connected to said chambers, said valve plates having peripheral recesses with edges which are cooperable with said ring gear so that when said drive means rotates in one direction one of said valve plates sequentially opens said expansible chambers on one side of said line of eccentricity while the other of said valve plates sequentially opens said expansible chambers on the other side of said line of eccentricity, and vice versa.

* * * * *